US011299372B2

(12) United States Patent
Christen et al.

(10) Patent No.: US 11,299,372 B2
(45) Date of Patent: Apr. 12, 2022

(54) CLIMBING ELEVATOR SYSTEM HAVING A PROTECTIVE ROOF

(71) Applicant: Inventio AG, Hergiswil (CH)

(72) Inventors: Lukas Christen, Glattpark/Opfikon (CH); Pascal Bläsi, Dierikon (CH); Stefan Weber, Niederwil (CH)

(73) Assignee: INVENTIO AG, Hergiswil NW (CH)

( * ) Notice: Subject to any disclaimer, the term of this patent is extended or adjusted under 35 U.S.C. 154(b) by 481 days.

(21) Appl. No.: 16/311,230

(22) PCT Filed: Jun. 28, 2017

(86) PCT No.: PCT/EP2017/065981
§ 371 (c)(1),
(2) Date: Dec. 19, 2018

(87) PCT Pub. No.: WO2018/002132
PCT Pub. Date: Jan. 4, 2018

(65) Prior Publication Data

US 2019/0193995 A1 Jun. 27, 2019

(30) Foreign Application Priority Data

Jun. 30, 2016 (EP) ..... 16177324

(51) Int. Cl.
*B66B 11/00* (2006.01)

(52) U.S. Cl.
CPC ..... *B66B 11/0005* (2013.01)

(58) Field of Classification Search
CPC ..... B66B 11/0226; B66B 11/0246; B66B 5/0056; B66B 11/006; B66B 19/007; B66B 19/04; E04B 7/00; E04B 7/18; E04B 1/34
See application file for complete search history.

(56) References Cited

U.S. PATENT DOCUMENTS 2,739,776 A * 3/1956 Terando ..... B65D 19/0002 108/54.1
3,851,736 A 12/1974 Westlake et al.
(Continued)

FOREIGN PATENT DOCUMENTS

CN 202227711 U * 5/2012
CN 103303771 A 9/2013
(Continued)

OTHER PUBLICATIONS

"Intelligente EntiUftungs-, Warmeabzugs-AbkUhlungs- nd Rauchabzugsanlage (EWAR) fUr Aufzugsschachte und Triebwerksraume", Lift-Report, RRD GMBH, Dortmund, DE, vol. 35, No. 5, May 1, 2009 (May 1, 2009), pp. 155-156, XP001554222, ISSN: 0341-3721, the whole document.

*Primary Examiner* — Michael R Mansen
*Assistant Examiner* — Michelle M Lantrip
(74) *Attorney, Agent, or Firm* — William J. Clemens; Shumaker, Loop & Kendrick, LLP

(57) ABSTRACT

A climbing elevator system has an elevator shaft and an elevator car, a lifting platform, and a supporting device, wherein, in the course of different construction phases of a building, the lifting platform can be anchored at various positions within the elevator shaft. A protective roof is arranged above components of the lifting platform that are to be protected, such as a drive machine. The protective roof has a central roof structure and a peripheral flank structure that has flank walls fixed to the lateral edges of the central roof structure and project outwardly from the central roof structure at an angle with respect to the horizontal. Because of the inclined arrangement of the flank walls, the flank structure can better withstand falling objects and better protect components located underneath. Cantilevered edge
(Continued)

regions of the flank walls can be supported on side walls of the elevator shaft.

16 Claims, 4 Drawing Sheets

(56) References Cited

U.S. PATENT DOCUMENTS

| | | | | |
|---|---|---|---|---|
| 3,977,333 | A * | 8/1976 | Phillips | B65D 19/0073 108/54.1 |
| 5,743,063 | A * | 4/1998 | Boozer | E04B 7/00 52/508 |
| 8,141,683 | B1 * | 3/2012 | Wurth | B66B 19/00 182/223 |
| 2005/0150728 | A1 * | 7/2005 | Van Der Meijden | B66B 19/002 187/411 |
| 2009/0223751 | A1 * | 9/2009 | Peacock | B66B 7/027 187/414 |

FOREIGN PATENT DOCUMENTS

| | | | |
|---|---|---|---|
| CN | 203428702 | U * | 2/2014 |
| CN | 103991779 | A | 8/2014 |
| CN | 204958069 | U | 1/2016 |
| CN | 205034926 | U | 2/2016 |
| EP | 2604565 | A1 | 6/2013 |
| FR | 1557755 | A | 2/1969 |
| RU | 2033381 | C1 | 4/1995 |
| WO | 2015003964 | A1 | 1/2015 |

* cited by examiner

CLIMBING ELEVATOR SYSTEM HAVING A PROTECTIVE ROOF

FIELD

The present invention relates to an elevator system, in particular in the form of a climbing elevator system, comprising a specifically formed protective roof.

BACKGROUND

Elevator systems are generally used to be able to transport passengers and/or objects within existing buildings typically in a vertical direction. For this purpose, an elevator car can be displaced within the elevator shaft by means of a supporting means, such as one or more cables or belts.

Before the elevator system can be operated in its normal mode of operation, it may possibly be installed in the building during a construction phase, during which a building is not yet completed. It is therefore possible that the elevator system is already used for transporting passengers and/or material during the construction phase, and that said system can grow along with the building during construction thereof. In this manner, separate external elevators, which would be attached to the outside of the building, for example, can be dispensed with during the construction phase.

For this purpose, for example, part of the guide rails and an elevator car can already be installed in the elevator shaft provided for the elevator system at a point in time at which only one or more lower floors of the building have been completed. The elevator car and additional components of the elevator system, such as a counterweight, can be suspended on the lifting platform typically by means of the supporting means. A drive machine can be provided on the lifting platform, which drive machine can displace the supporting means, for example by means of a drive sheave. The lifting platform can be lifted to the next-highest level by means of a crane or other means, for example, in order to lengthen the transport path of the elevator system.

For example, in the case of a climbing elevator system, the guide rails and/or holding rails of the elevator system provided for guiding the lifting platform are mounted in the elevator shaft successively during the construction phase of the building and the lifting platform is conveyed upwards on the guide rails and/or holding rails as required. The lifting platform can then be fixed at a desired higher position, for example by means of struts, which can be pushed out of the lifting platform into openings in the walls of the elevator shaft, for example.

WO 2015/003964 A1 discloses an example of a climbing elevator system.

In particular in the case of an elevator system used during the construction phase of a building, there may be a risk that components of the elevator system can be damaged by dirt or falling objects. Passengers inside the elevator shaft, such as maintenance personnel, could also be harmed by falling objects, for example.

Therefore, there may be a requirement, inter alia, for an elevator system in which components of the elevator system and/or passengers in the elevator shaft are efficiently protected against falling objects or dirt.

SUMMARY

According to one aspect of the invention, an elevator system is proposed which has at least one elevator shaft and typically an elevator car, a lifting platform, and a supporting means. In this case, the elevator car is held on the supporting means and can be displaced within the elevator shaft by means of the supporting means. The supporting means is in turn held on the lifting platform, for example securely anchored or running over a roller. Provided in the elevator shaft, preferably above the lifting platform, is a protective roof. A protective roof of this kind is sometimes referred to as a crash deck. In this case, the protective roof is arranged preferably above components of the lifting platform that are to be protected or above a working plane, for example the shaft pit. The protective roof has a central roof structure and a peripheral flank structure. The flank structure has flank walls which are fixed to the roof structure, in particular to lateral edges of the roof structure, and which are arranged to project outward from the central roof structure at an angle with respect to the horizontal.

Possible features and advantages of embodiments of the present invention may be considered, among others and without limiting the invention, to be based on the ideas and findings described in the following.

Embodiments of the elevator system proposed herein correspond to conventional elevator systems with regard to many of the components thereof. An elevator system according to the invention usually has, inter alia, an elevator car in which passengers or objects can be transported. In this case, the elevator car can be displaced within the elevator shaft, often vertically. For this purpose, the elevator car can be held by supporting means, such as cables or belts, and the supporting means is in turn held on the lifting platform located further above. The lifting platform is therefore designed to hold the weight of the elevator car, and optionally a counterweight also fixed on the supporting means, by means of the supporting means held thereon. The supporting means can also be held on the lifting platform such that said platform can be displaced and therefore the elevator car suspended on the supporting means can also be displaced. For this purpose, a drive machine may be arranged on the lifting platform, which drive machine is used to drive the supporting means. The drive machine can, for example, drive a drive sheave in a rotating manner and the supporting means can be placed around the drive sheave, in order to be able to be displaced thereby. Alternatively, only deflection rollers may be provided on the lifting platform, around which rollers the supporting means is wound and a drive machine may be arranged at another position within the elevator shaft or within a machine room, in order to be able to displace the supporting means. Other configurations in which the supporting means can be suspended on the lifting platform securely or so as to be displaceable relative thereto can also be used.

Embodiments of the elevator system proposed herein differ from conventional elevator systems in particular due to the protective roof to be provided in the elevator shaft and the specific design thereof.

The protective roof is provided, inter alia, in order to protect components of the lifting platform located beneath the protective roof in particular from falling objects coming from above and optionally from dirt or water. Passengers in the elevator shaft beneath the protective roof can also be protected.

This can be advantageous in particular if the elevator system with its lifting platform is designed to be fixed temporarily at various positions within the elevator shaft, i.e. if the elevator system as a climbing elevator system is designed to already be used in a building during a construction phase and to virtually grow along with the building during this construction phase by successive displacement of the lifting platform. During a construction phase of this kind, the elevator shaft in the building is typically still open at the top. In addition, the lifting platform is typically not arranged at the highest point of the building or at least of the elevator shaft, as is usually the case in completed buildings. There may therefore be an increased risk that objects coming from further above in the building, such as screws or tools, accidentally fall into the elevator shaft and therefore can damage components of the elevator system therein, in particular of the lifting platform or of a drive machine optionally arranged therein. Sensitive components of the lifting platform or of the drive machine can furthermore be damaged by dirt or water coming from above, e.g. rain.

In order to prevent damage of this kind as far as possible, a protective roof is provided in conventional climbing elevator systems above components that are to be protected.

However, it has been found that conventionally used protective roofs are typically very difficult to install on the lifting platform. In particular, it has often been difficult to install the protective roof such that, if possible, there is no gap, or in any case a very narrow gap, between the protective roof and walls of the elevator shaft, through which gap falling objects can pass. Previously necessary complex installation and adaptation of the protective roof to the geometry of the elevator shaft often leads to considerable additional effort arising when the lifting platform is displaced within the elevator shaft, solely due to the disassembly initially required and then necessary reassembly of the protective roof after displacement.

It has further been found that in conventional protective roofs, sufficient stability and therefore resistance to falling objects could be ensured only with high outlay. In particular in border regions in which the protective roof adjoins walls of the elevator shaft, the protective roof must be designed to be particularly stable, which could involve high outlay with regard to construction, material and weight.

In order to overcome deficiencies of conventional protective roofs, it is proposed for embodiments of the elevator system according to the invention to assemble the protective roof from a central roof structure and a peripheral flank structure.

In this case, the central roof structure may be arranged above central regions of the lifting platform and cover said regions. In particular, a central roof structure can be designed and dimensioned such that, for example, it does not need to be disassembled when the lifting platform is to be displaced within the elevator shaft. For example, the central roof structure can be dimensioned such that its edges are at a sufficient distance, i.e. for example at a distance of at least 10 cm, preferably at least 30 cm, from side walls of the elevator shaft. The central roof structure may comprise, for example, a plate made of a sufficiently stable material, for example a metal plate having a thickness which is sufficient for a protective function, typically of at least 3 mm, preferably at least 5 mm. Said central roof structure may also be composed of a plurality of plates.

Regions of the peripheral flank structure are adjacent to the lateral edges of the central roof structure in each case. The peripheral flank structure is therefore arranged predominantly in regions between the central roof structure and surrounding side walls of the elevator shaft. The peripheral flank structure covers these regions as far as possible. A combination of the central roof structure and peripheral flank structures therefore covers large regions of the cross section of the elevator shaft. As described in more detail below, potentially remaining gaps between the flank structure and walls of the elevator shaft should be as small as possible, so that no objects of significant size can pass through them. Components or passengers located beneath the protective roof are therefore well-protected against falling objects.

The flank structure of the protective roof is designed in a specific way in this case. Said flank structure comprises flank walls which are fixed to the lateral edges of the central roof structure. These flank walls project outward from the roof structure, i.e. toward an adjacent wall of the elevator shaft in each case. In this case, the flank walls are not oriented horizontally, however, but instead extend at an angle that is inclined with respect to the horizontal. In other words, the protective roof, in particular at its lateral edges formed by the flank walls, does not extend horizontally, but instead is inclined with respect to the horizontal, preferably at an acute angle.

The arrangement of the flank walls at an angle can have the advantageous effect that forces caused by falling objects that act on the edge of the protective roof can be reduced on the roof. In this case, a falling object does not impact a horizontally extending region of the protective roof and therefore locally transmits a significant pulse there. Instead, the falling object impacts the flank wall arranged at an angle and is diverted to the side, i.e. as far as possible toward the central roof structure. In this case, merely a smaller pulse in terms of magnitude is exerted on the flank wall in the lateral region of the protective roof; the force produced on the flank wall as a result has an effect such that the force can be diverted to the central roof structure or to the side walls.

Overall, providing a flank structure at an angle to the horizontal has the effect that mechanical stability of the protective roof can be improved, in particular in these vulnerable border regions. This takes into account the fact that in particular in these border regions, the risk that the protective roof will be impacted by falling objects is particularly high and that it is also difficult to construct the protective roof so as to be sufficiently stable in these border regions. The protective roof can therefore be designed so as to be sufficiently stable with relatively low constructive effort.

According to one embodiment, the lower end regions of the flank walls are fixed to the roof structure. In other words, the flank walls are fixed at the bottom to the edges of the central roof structure and project obliquely outward and upward from the central roof structure. The flank walls arranged at an angle can therefore form a kind of funnel, so that objects falling from above onto the flank walls are deflected toward the central roof structure and can be collected there.

According to one embodiment, the flank walls are arranged at an angle of between 20° and 70°, preferably of between 30° and 60°, more preferably of between 40° and 50°, to the horizontal. Flank walls oriented at an acute angle to the horizontal of this kind can deflect falling objects effectively without being excessively mechanically overloaded themselves. The larger the angle to the horizontal is selected to be, the smaller the forces exerted on impact with the flank walls. However, the inclined flank walls must be wider in the case of a higher selected angle to the horizontal of this kind, in order to be able to bridge a region between a central roof structure and the walls of the elevator shaft. The inclined flank walls should not be excessively wide, however, for reasons of minimal material consumption. The smaller the angle to the horizontal is selected to be, the narrower the flank walls that are able to cover this region.

The flank walls may be flat, for example in the form of flat metal sheets. In this case, the angle of said walls to the horizontal is clearly defined. However, the flank walls may also be bent in on themselves, so that the same flank wall can comprise various regions that are inclined at various angles with respect to the horizontal. In this case, "the angle to the horizontal" is understood to mean an average angle to the various regions of a flank wall.

According to one embodiment, the peripheral flank walls are reversibly detachably fixed to the central roof structure. In other words, the flank walls can be assembled on and disassembled from the roof structure multiple times. The central roof structure and the flank walls to be attached thereto are provided in this case as separate components to be releasably connected to one another.

If the lifting platform is lifted to another height within the elevator shaft due to progress in the construction phase, it may be necessary to temporarily disassemble parts of the protective roof during this displacement at least in regions, as they could otherwise impede displacement of the lifting platform. In the elevator system proposed here, it may be sufficient to disassemble only the flank structure so that said structure does not come into conflict with components protruding into the elevator shaft, for example, during displacement of the lifting platform. As soon as the lifting platform has reached its new position and has been anchored there, the protective roof can be completely reassembled, i.e. the flank walls can be attached to the roof structure.

In this case, it may be advantageous, according to one embodiment, to fix the flank walls to the central roof structure by means of a fixing structure in each case, the fixing structure being designed to allow the flank walls to be fixed detachably and at positions at various distances from a relevant edge of the roof structure.

In other words, a specific fixing structure can be provided for fixing the flank walls to the roof structure, which fixing structure makes it possible to fix the flank walls detachably to the central roof structure and which is also designed such that the flank walls can be fixed at various positions relative to the edge of the central roof structure.

By means of the fixing structure, a flank wall can therefore be fixed, as required, to the roof structure nearer or further away from the relevant edge of the roof structure, so that said wall protrudes laterally over the roof structure to a greater or lesser extent. The positioning of the flank walls can therefore be adapted to conditions locally changing inside the elevator shaft, for example. In this case, the fixing structure should advantageously make it possible to continuously variably position the relevant flank wall.

According to one specific embodiment, the corner fixing structure comprises a reversibly releasable and attachable tongue and groove joint, which holds the flank wall in only at least one spatial direction, preferably in two spatial directions, when released and which holds the flank wall in three spatial directions when attached.

In other words, a flank wall can be fixed to the roof structure by means of a fixing device designed as a tongue and groove joint. The tongue and groove joint should be both securely attachable and reversibly releasable. When attached, the tongue and groove joint holds the flank wall securely in position, so that the flank wall substantially cannot be moved in any spatial direction. When attached, the flank wall is therefore held in three mutually orthogonal spatial directions. In this case, the flank wall can be spatially attached both by positive fit and by non-positive fit, which are achieved by the tongue and groove joint.

However, it should be possible to reversibly release the tongue and groove joint, the flank wall being held merely in two spatial directions when said joint is released, preferably by means of positive fit, and it therefore being possible to displace said wall in a direction that is orthogonal to these two spatial directions. Preferably, this third spatial direction, which can be freely displaced when said joint is released, extends orthogonally or at least obliquely crosswise to the edge of the central structure. Correspondingly, the flank wall can be displaced orthogonally or obliquely to said edge of the central roof structure when the tongue and groove joint is released.

Such displaceability of the lateral flank walls, which is permitted when the tongue and groove joint is released, can be used, inter alia, to temporarily displace the flank walls towards the center of the roof structure, in order to be able to lift the roof structure, together with the lifting platform, within the elevator shaft, for example. In this case, the flank walls do not need to be completely disassembled, but instead it may be sufficient to release the tongue and groove joint and to displace the flank walls only inward, although said walls are still held in the other two spatial directions. Once at the new position for the lifting platform, the flank walls can then be pushed back outward toward the walls of the elevator shaft and subsequently the tongue and groove joint can be attached.

According to one embodiment, the flank walls are to be fixed to the roof structure in a position and orientation in which edge regions of the flank walls, which are arranged opposite end regions of the flank walls that are fixed to the roof structure, are at a distance from side walls of the elevator shaft of less than 30 mm, preferably less than 10 mm. Alternatively, the flank walls can be fixed to the roof structure in a position and orientation in which edge regions of the flank walls, which are arranged opposite end regions of the flank walls that are fixed to the roof structure, are arranged so as to rest on the side walls of the elevator shaft.

In other words, the flank walls themselves and the fixing structure used to fix said walls to the roof structure can be designed such that each flank wall can be fixed to the roof structure in a position and orientation in which the flank wall extends nearly to an adjacent side wall of the elevator shaft. End regions of the flank walls that are directed towards the central roof structure are fixed to the roof structure. Edge regions opposing these end regions extend almost as far as the adjacent wall of the elevator shaft, so that any remaining gap between the flank wall of the protective roof and the side wall of the elevator shaft is very small, in particular smaller than 30 mm, and therefore it is difficult for heavy objects to fall through gaps of this kind.

Alternatively, according to one embodiment of the invention, the flank walls may be intended to be fixed to the roof structure in a position and orientation in which edge regions of the flank walls, which are arranged opposite end regions of the flank walls that are fixed to the roof structure, rest on side walls of the elevator shaft.

In this case, it should be possible to fix the flank walls to the central roof structure such that the outer edge regions of said walls are not at a distance from the relevant adjacent side wall of the elevator shaft, but rather can rest mechanically thereon. The outer edge region of the flank wall can therefore be supported on the side wall of the elevator shaft. This can further increase the mechanical strength of the flank wall. For example, forces that are produced when a falling object impacts a flank wall may be diverted into the central roof structure, but also partially into the side wall of the elevator shaft that is contacted by the flank wall.

According to one embodiment, the flank structure has corner structures. In this case, a corner structure has two corner flank walls which are at an angle to one another, are fixed to one another along an edge and are each arranged so as to be inclined with respect to the horizontal.

In other words, the flank structure may have specific corner structures. Each corner structure has two corner flank walls in this case. These corner flank walls adjoin one another at an edge and are fixed to one another along said edge. The two corner flank walls can be fixed reversibly or irreversibly in this case. In particular, the two corner flank walls can be reversibly screwed to one another or, preferably, irreversibly welded or riveted to one another or similar along the edge. In this case, the corner flank walls are designed and connected to one another such that they are arranged at an angle relative to one another and are thereby both arranged so as to be inclined with respect to the horizontal. In other words, a corner structure may have the form of a corner of an angular funnel opening upward.

The corner structures may be provided as separate components which can be fixed to the central roof structure independently of one another in each case and/or independently of other parts of the flank structure.

According to one embodiment, a corner structure can be fixed to the roof structure by means of a corner fixing structure. In this case, the corner fixing structure may be designed to make it possible to fix the corner structures detachably and at various positions at a distance from a relevant corner of the roof structure.

In other words, it may be possible to detachably fix a corner structure to the roof structure at various positions. In this case, the positions may be more or less close to a relevant corner of the roof structure. A corner structure fixed to the roof structure in the lower end regions thereof can, by means of the corner flank walls thereof arranged at an angle to the horizontal, project outward beyond the edges of the roof structure near the relevant corner and extend into a corner formed by side walls of the elevator shaft.

When assembled, a corner structure can fill one corner of the elevator shaft as completely as possible. For example, a lateral distance between the corner structure and a relevant side wall of the elevator shaft may be less than 30 mm. Alternatively, the cantilevered edge of the corner structure may rest on the respective side walls of the elevator shaft. Gaps between the side walls of the elevator shaft and the protective roof can therefore be prevented or at least minimized.

According to one embodiment, the corner fixing structure may have a reversibly releasable and attachable tongue and groove joint. This tongue and groove joint can hold the corner structure in only at least one spatial direction, preferably in two spatial directions, when released, similarly to the tongue and groove joint described further above, and can hold the corner structure in three spatial directions when attached.

In other words, a tongue and groove joint can in turn be used to detachably fix a corner structure to the central roof structure such that when the tongue and groove joint is released, the corner structure can be displaced along the central roof structure toward or away from a corner thereof.

The corner structures can therefore be displaced temporarily toward the center of the central roof structure, for example, in order to be able to displace the lifting platform together with the protective roof, for example. After a target position has been reached, the protective roof can be reassembled such that it completely covers the cross section of the elevator shaft. For this purpose, the corner structures can be pushed outward toward the corners of the elevator shaft and the tongue and groove joint can therefore be attached.

According to one embodiment, the flank walls have a wall thickness of at least 3 mm, preferably at least 5 mm. Sufficiently high mechanical strength of the flank walls can be achieved by means of a wall strength of this kind. In particular, this can prevent flank walls from being easily penetrated by falling objects.

According to one embodiment, the flank walls consist of metal or of a composite material provided with a metal layer. Although the flank walls can, in principle, consist of any sufficiently mechanically stable material, such as plastics material, plastics composite materials, wood, wood composite materials or similar, it is considered advantageous to form the flank walls of metal or at least having a metal layer, as sufficient mechanical strength, but also simple production with low production and material costs, can be achieved.

It should be noted that some of the possible features and advantages of the invention are described herein with reference to different embodiments. A person skilled in the art recognizes that the features can be combined, adapted or replaced as appropriate in order to arrive at further embodiments of the invention.

Embodiments of the invention will be described in the following with reference to the accompanying drawings, neither the drawings nor the description being intended to be interpreted as limiting the invention.

DESCRIPTION OF THE DRAWINGS

The invention is explained in greater detail in the following with reference to drawings, in which:

FIG. 4(*b*) is an enlarged view of a region from FIG. 4(*a*); and

FIG. 4(*c*) is a sectional view along the line A-A from FIG. 4(*b*).

The drawings are merely schematic and not to scale. Like reference signs refer in different drawings to like or analogous features.

DETAILED DESCRIPTION

Figure 1:
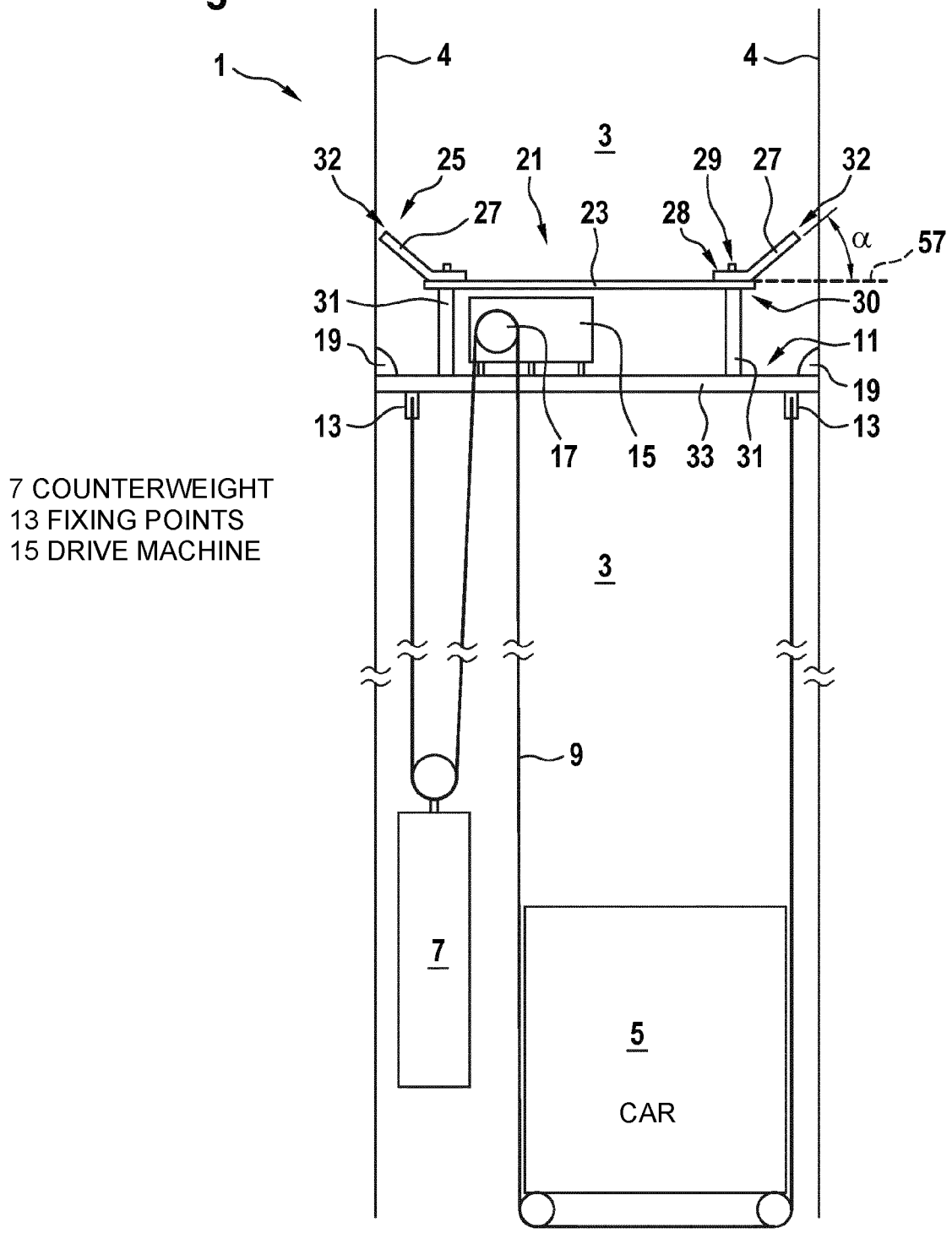
FIG. 1 is a sectional side view through an elevator system according to one embodiment.

FIG. 1 shows an elevator system 1 in the form of a climbing elevator system according to an embodiment of the present invention.

The elevator system 1 comprises an elevator shaft 3, in which an elevator car 5 and a counterweight 7 are accommodated. The elevator car 5 and the counterweight 7 are held on a lifting platform 11 by means of a supporting device or means 9. The supporting means 9 typically comprises a plurality of cables or belts. The lifting platform 11 is securely fixed at least temporarily in the elevator shaft 3. Fixing points 13 are attached to the lifting platform 11, on which points ends of the supporting means 9 are held securely. Furthermore, a drive machine 15 is provided on the lifting platform 11. This drive machine 15 drives a drive sheave 17 in a rotating manner. The supporting means 9 is wound around the drive sheave 17 and can therefore be displaced by the rotating drive sheave 17, as a result of which the elevator car 5 and the counterweight 7 can be moved in opposite directions within the elevator shaft 3.

The elevator system 1 is designed to already be used in a building during a construction phase. This means that the elevator system 1 can already be operated when the building accommodating it is only partly completed. After specific progress in construction, the lifting platform 11 can be displaced upwards within the elevator shaft 3, which allows the elevator system 1 to "grow" along with the building. In order to displace the lifting platform 11, anchors 19 (shown merely schematically) can be temporarily detached, then the lifting platform 11 can be lifted, for example by means of a crane, and optionally the supporting means 9 is extended accordingly and finally the lifting platform 11 is anchored to its new position back in the elevator shaft 3.

In order to protect components of the lifting platform 11 and/or of the units assembled thereon, such as the drive machine 15, against objects falling through the elevator shaft 3, a protective roof 21 is provided above such components to be protected, which protective roof is intended to act as a crash deck. In the example shown, the protective roof 21 is supported on a support plate 33 of the lifting platform 11 by supports 31 and spans wide parts, which are above the components to be protected, of the cross-sectional area of the elevator shaft 3. In this case, the protective roof 21 is designed, due to its geometric design and due to the choice of material for its components, such that it has sufficient stability to be able to protect the components, located underneath, that are to be protected from objects falling from above, such as typically screws, tools, small stones etc., for example during installation of the guide rails.

Figure 2:
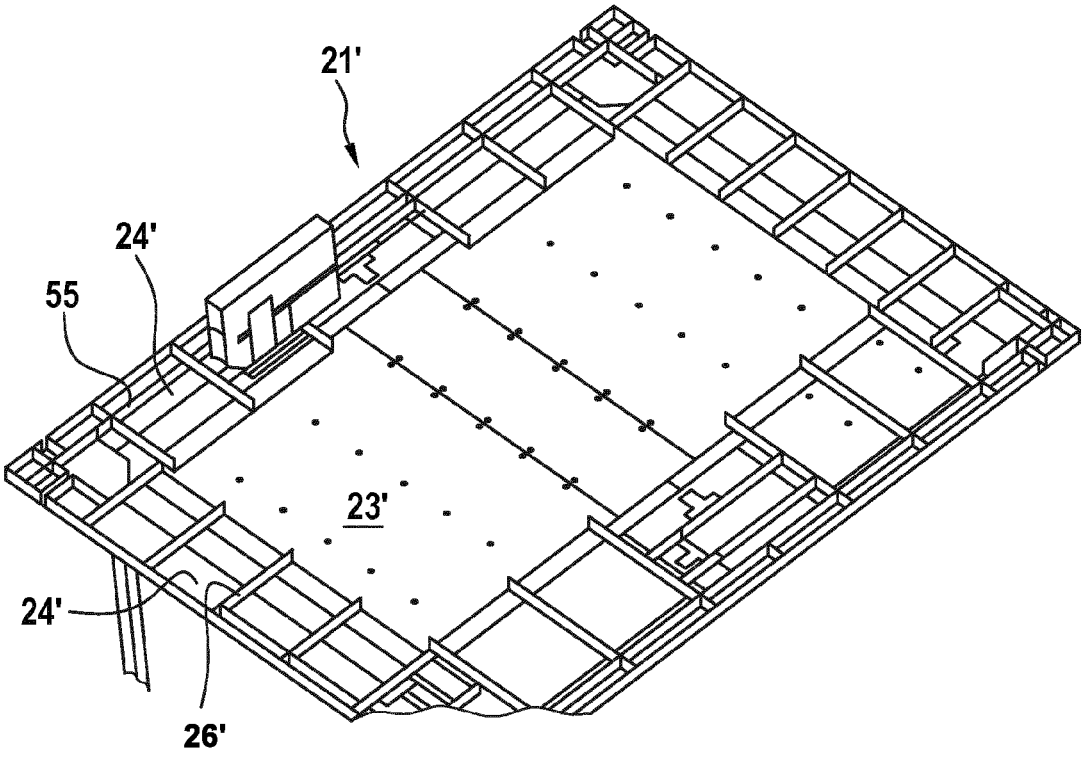
Fig. 2 (Prior Art)
FIG. 2 is a perspective view from above of a protective roof of a conventional elevator system.
Figure 3:
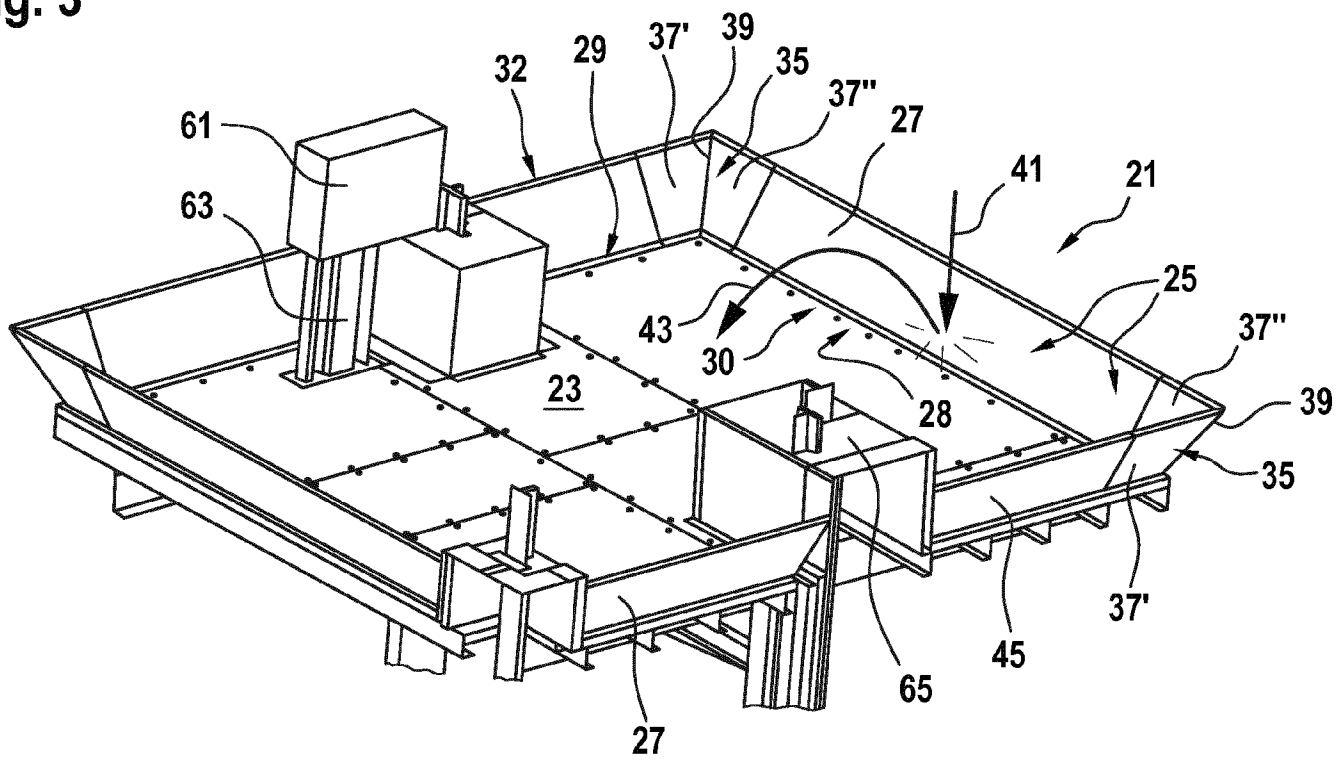
FIG. 3 is a perspective view from above of a protective roof of an elevator system according to an embodiment.

Before commenting on details of a protective roof 21 for an elevator system according to the invention with reference to FIG. 3, a protective roof 21' shown in FIG. 2, as is conventionally used in elevator systems, should be briefly explained.

The conventional protective roof 21' substantially has a flat geometry over its entire surface area. Planar metal sheets 24' are also bolted to the edges of a planar central roof structure 23'. In this case, the central roof structure 23' and the metal sheets 24' extend substantially in the same plane or in mutually parallel planes and are usually each oriented horizontally. The metal sheets 24' are used in this case to bridge or close the existing gap between the central roof structure 23' and walls 4 of the elevator shaft 3 at least in part.

As projections, for example in the form of guide rails, fixing clamps etc., can project inward at several points in the elevator shaft 3, the metal sheets 24' have to be detached and removed from the central roof structure 23' before the lifting platform 11, together with the protective roof 21', can be displaced to another position within the elevator shaft 3, for example.

Detaching the metal sheets 24' and later reattaching the metal sheets 24' and in particular precisely orienting said sheets in order to bridge existing gaps can be labor-intensive and time-consuming.

It can also be difficult to design the metal sheets 24' so as to be sufficiently stable, so that these sheets can withstand the considerable forces caused by falling objects. This is the case in particular as the metal sheets 24' are supported merely on the side thereof oriented toward the central roof structure 23', but are cantilevered on an opposing side. It may be necessary to design the metal sheets 24' elaborately, i.e. to provide them with reinforcing struts 26', in order to make them sufficiently mechanically resistant.

Possible details of a protective roof 21 are described for an elevator system 1 according to the invention with reference to FIG. 3.

The protective roof 21 comprises, similarly to the conventional protective roof 21' described in FIG. 2, a central roof structure 23. The central roof structure 23 is preferably flat and may consist substantially of one plate or a plurality of combined plates, for example metal plates or metal composite plates or sufficiently thick wooden panels.

A flank structure 25 is provided adjacent to lateral edges 30 of the roof structure 23. The flank structure 25 assumes substantially the same functions as the metal sheets 24' of the conventional roof structure 23' shown in FIG. 2. However, the flank structure 25 is not composed of horizontal metal sheets 24', as is the case with the conventional protective roof 21', but rather comprises flank walls 27, the lower end regions 28 of which (see enlarged in FIG. 4(*b*)) are fixed to the lateral edges 30 of the roof structure 23 in and which walls project outward obliquely upward therefrom at an angle to the horizontal 57.

As shown in FIG. 1, the flank walls 27 are arranged in this case at an angle $\alpha$ of typically between 40° and 50° to the horizontal 57. In this case, the flank walls 27 extend as far as or at least slightly in front of an adjacent side wall 4 of the elevator shaft 3 and therefore close a gap that would otherwise be between the central roof structure 23 and the side wall 4.

Due to its arrangement at an angle to the horizontal 57, the flank walls 27 of the flank structure 25 can protect the components to be protected located underneath particularly well against falling objects. As shown in FIG. 3 by arrows 41, 43, an object coming from above first strikes one of the oblique flank walls 27. As its usually vertical direction of fall is at an acute angle to the oblique surface of the flank wall 27, the object ricochets off the flank wall 27 and is moved toward the center of the roof structure 23. In the case of an acute-angled ricochet of this kind, substantially smaller forces are exerted on the flank structure 25 than is the case for horizontal metal sheets 24', as have conventionally been used in protective roofs 21'. In addition, an obliquely extending flank wall 27 can optionally also be supported on an adjacent side wall 4 of the elevator shaft 3 during impact.

Finally, it will be explained in detail, with reference to FIG. 4, how the protective roof 21 of the elevator system 1 according to the invention, and in particular the flank structure 25 thereof, can be advantageously designed and therefore advantageously assembled.

The flank structure 25 and its flank walls 27 may be composed of various components. In the example shown, the flank structure 25 comprises corner structures 35 and side structures 45.

Each corner structure 35 comprises two corner flank walls 37', 37" oriented at an angle of 90°, for example, to one another. Each corner flank wall 37', 37" may be formed by means of a flat metal sheet or a flat plate. The two corner flank walls 37', 37" are fixed to one another at an adjoining edge 39, for example welded, bonded, riveted, screwed to one another or similar. The two corner flank walls 37', 37" are arranged at an angle to the horizontal.

A lower end region 28 of the corner flank walls 37', 37" is offset such that said region extends substantially horizontally. Each corner flank wall 37', 37", and therefore the entire corner structure 35, is fixed to the central roof structure 23 at this lower end region 28.

For the purposes of fixing, a corner fixing structure in the form of a reversibly releasable and attachable tongue and groove joint 29 is used. This is shown schematically in a side view in the enlarged detail from FIG. 4(*c*). In a simple design, the tongue and groove joint 29 comprises a screw 47, which is screwed into the central roof structure 23, and a slot 49 provided in the lower offset end region 28 of the corner flank wall 37', 37". If the screw 47 is not firmly tightened, the corner flank wall 37', 37" can be displaced toward the slot 49, i.e. toward or away from a corner 59 of the central roof structure 23 in the direction shown by the arrow 51. However, in the two other orthogonal spatial directions, the tongue and groove joint 29 prevents movements of the corner flank wall 37', 37". Owing to this degree of freedom of movement made possible by the tongue and groove joint 29, the corner structure 35 can therefore be moved toward the center of the central roof structure 23 or, conversely, away from said center outward toward a corner of the elevator shaft 3. As soon as the corner structure 35 has been brought into a desired position, the screw 47 can be tightened and the tongue and groove joint 29 can therefore be attached, so that the corner structure 35 is securely fixed to the roof structure 23 in all three spatial directions.

After the corner structure 35 has been fixed to the central roof structure 23 in this way and brought into a desired position, in which the upper corners of said structure are arranged near the walls 4 of the elevator shaft 3, and has been fixed there, the side structures 45 can be attached to the roof structure 23 and/or brought into the desired position. In this case, the side structures 45 may be formed by metal sheets or plates, for example, which are offset in the lower end regions 28 thereof, similarly to the corner flank walls 37', 37", and are fixed to edges of the central roof structure 23 by means of fixing structures formed, for example, as tongue and groove joints 29. When the tongue and groove joint 29 is released, the side structures 45 can be displaced transversely to an adjacent edge 30 of the central roof structure in a direction indicated by the arrow 53, and therefore can be displaced toward adjacent side walls 4 of the elevator shaft 3. In this case, the side structures 45 can be preferably displaced so far outward that the cantilevered edge regions 32 thereof, which are arranged opposite the lower end regions 28, strike the side walls 4 of the elevator shaft 3.

Figure 4:
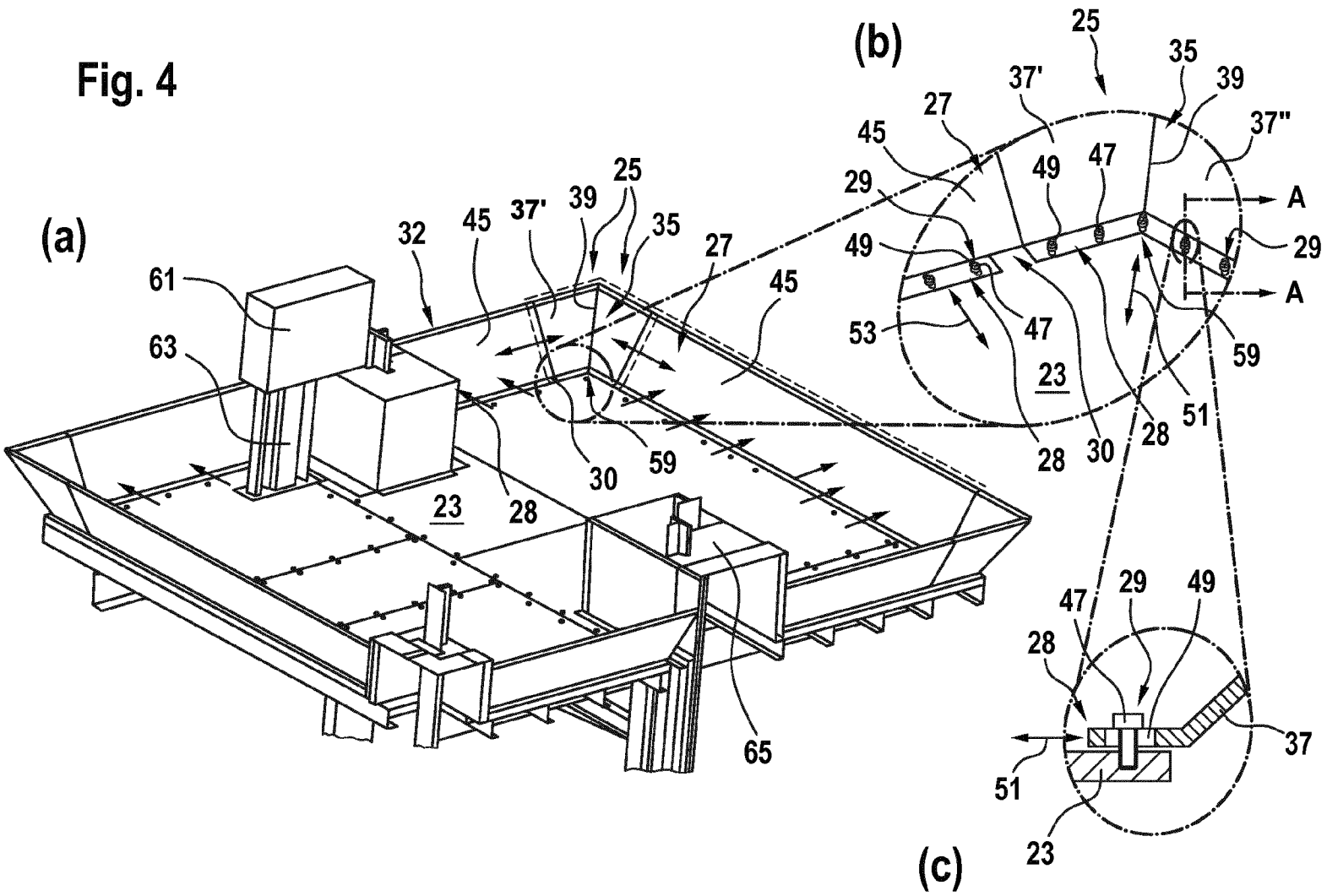
FIG. 4(*a*) shows details and an assembly process for the protective roof shown in FIG. 3.

For the sake of completeness, it should be noted that FIGS. 3 and 4 show even more components of the elevator system 1, such as a speed-limiting device 61, a cable cover 63 and a cover 65 for a guide shoe, which components are not essential for understanding the present invention, however.

Finally, it should be noted that terms such as "comprising," "having" etc. do not preclude other elements or steps and terms such as "a/an" or "one" do not preclude a plurality. Furthermore, it should be noted that features or steps that have been described with reference to one of the embodiments above can also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system comprising:

an elevator shaft; and a protective roof arranged inside the elevator shaft, wherein the protective roof has a central roof structure extending in a horizontal plane and a peripheral flank structure extending around an entire periphery of the central roof structure, wherein the flank structure has flank walls fixed to the central roof structure and the flank walls project outwardly from the central roof structure at a predetermined angle oblique with respect to the horizontal plane, and the flank structure further includes corner structures connected to the flank walls and inclined at the oblique angle with respect to the horizontal plane.

2. The elevator system according to claim 1 wherein lower end regions of the flank walls are fixed to the central roof structure.

3. The elevator system according to claim 1 wherein the predetermined angle is between 20° and 70° to the horizontal plane.

4. The elevator system according to claim 1 wherein the flank walls are fixed to the central roof structure in a reversibly detachable manner.

5. The elevator system according to claim 1 wherein the flank walls are each fixed to the roof structure by a fixing structure, wherein the fixing structure allows each of the flank walls to be fixed detachably and at various positions at selected distances from an associated edge of the central roof structure.

6. The elevator system according to claim 5 wherein the fixing structure includes a reversibly releasable and attachable tongue and groove joint holding the flank walls in only one or two spatial directions when released and holding the flank walls in three spatial directions when attached.

7. The elevator system according to claim 1 wherein the flank walls are fixed to the central roof structure in a position and orientation wherein cantilevered edge regions of the flank walls, which are arranged opposite end regions of the flank walls that are fixed to the central roof structure, are distanced from side walls of the elevator shaft by less than 30 mm.

8. The elevator system according to claim 1 wherein the flank walls are fixed to the central roof structure in a position and orientation wherein cantilevered edge regions of the flank walls, which are arranged opposite end regions of the flank walls that are fixed to the central roof structure, rest against side walls of the elevator shaft.

9. The elevator system according to claim 1 wherein the corner structures each have two corner flank walls that are at an angle to one another and are fixed to one another along a common edge and are each arranged inclined at the oblique angle with respect to the horizontal plane.

10. The elevator system according to claim 9 wherein the corner structures are fixed to the central roof structure by a corner fixing structure, wherein the corner fixing structure allows the corner structures to be fixed detachably and at positions at various selected distances from an associated corner of the central roof structure.

11. The elevator system according to claim 10 wherein the corner fixing structure includes a reversibly releasable and attachable tongue and groove joint that holds the corner structure in only one or two spatial directions when released and holds the corner structure in three spatial directions when attached.

12. The elevator system according to claim 1 wherein the flank walls have a wall thickness of at least 3 mm.

13. The elevator system according to claim 1 wherein the flank walls are formed of a metal material or of a composite material provided with a metal layer.

14. The elevator system according to claim 1 further comprising:

an elevator car;

a lifting platform;

a supporting means;

wherein the elevator car is held by the supporting means and is displaceable within the elevator shaft by the supporting means;

wherein the supporting means is held on the lifting platform; and wherein the protective roof is arranged above components of the lifting platform that are to be protected.

15. The elevator system according to claim 14 wherein one of the components is a drive machine arranged on the lifting platform for driving the supporting means.

16. The elevator system according to claim 14 wherein the lifting platform is adapted to be temporarily fixed at various selected positions within the elevator shaft.

* * * * *